US011384406B2

(12) United States Patent
Gao et al.

(10) Patent No.: US 11,384,406 B2
(45) Date of Patent: Jul. 12, 2022

(54) PRODUCTION METHOD FOR INLINE INCREASE IN PRECIPITATION TOUGHENING EFFECT OF TI MICROALLOYED HOT-ROLLED HIGH-STRENGTH STEEL

(71) Applicants: BAOSTEEL ZHANJIANG IRON & STEEL CO., LTD, Guangdong (CN); BAOSHAN IRON & STEEL CO., LTD., Shanghai (CN)

(72) Inventors: Xingjian Gao, Guangdong (CN); Jiachun Xu, Guangdong (CN); Ye Wang, Guangdong (CN)

(73) Assignees: BAOSTEEL ZHANJIAN IRON & STEEL CO., LTD., Guangdong (CN); BAOSHAN IRON & STEEL CO., LTD., Shanghai (CN)

( * ) Notice: Subject to any disclaimer, the term of this patent is extended or adjusted under 35 U.S.C. 154(b) by 138 days.

(21) Appl. No.: 16/648,773

(22) PCT Filed: Sep. 20, 2018

(86) PCT No.: PCT/CN2018/106706
§ 371 (c)(1),
(2) Date: Mar. 19, 2020

(87) PCT Pub. No.: WO2019/057115
PCT Pub. Date: Mar. 28, 2019

(65) Prior Publication Data

US 2020/0232054 A1 Jul. 23, 2020

(30) Foreign Application Priority Data

Sep. 20, 2017 (CN) ..... 201710853613.3
Jun. 19, 2018 (CN) ..... 201810631903.8

(51) Int. Cl.

| | |
|---|---|
| ***C21D 9/00*** | (2006.01) |
| ***B21B 45/00*** | (2006.01) |
| ***C21D 6/00*** | (2006.01) |
| ***C21D 8/00*** | (2006.01) |
| ***C22C 38/14*** | (2006.01) |

(52) U.S. Cl.
CPC ..... *C21D 9/0068* (2013.01); *B21B 45/008* (2013.01); *C21D 6/00* (2013.01); *C21D 8/005* (2013.01); *C22C 38/14* (2013.01)

(58) Field of Classification Search
CPC ..... C21D 9/0068; C21D 6/00; C21D 8/005; C21D 9/46; C21D 2211/004; C21D 8/021; C21D 8/0263; C21D 8/0226; C21D 1/84; C21D 8/02; C21D 9/0025; C21D 9/52; B21B 45/008; C22C 38/14
See application file for complete search history.

(56) References Cited

U.S. PATENT DOCUMENTS

| | | | | |
|---|---|---|---|---|
| 3,976,514 | A | 8/1976 | Matsukura et al. | |
| 4,973,367 | A * | 11/1990 | Matsuoka | C21D 8/0426 148/505 |
| 5,553,475 | A * | 9/1996 | Hayashi | B21B 1/088 72/11.6 |
| 5,803,989 | A * | 9/1998 | Kawamata | C21D 8/1261 148/120 |
| 6,264,769 | B1 * | 7/2001 | Benedetti | C21D 9/54 148/600 |
| 2014/0193667 | A1 * | 7/2014 | Shuto | C21D 8/0473 428/659 |
| 2014/0242414 | A1 * | 8/2014 | Minami | C22C 38/005 428/659 |

(Continued)

FOREIGN PATENT DOCUMENTS

| | | |
|---|---|---|
| CN | 102363858 A | 2/2012 |
| CN | 103114257 | 5/2013 |
| CN | 203064459 U | 7/2013 |

(Continued)

OTHER PUBLICATIONS

European Search Report dated Oct. 14, 2020 for European Patent Application No. 18858067.4.

(Continued)

*Primary Examiner* — John A Hevey

(74) *Attorney, Agent, or Firm* — Lei Fang; Smith Tempel Blaha LLC

(57) ABSTRACT

There is provided a production method for on-line improving precipitation strengthening effect of Ti microalloyed hot-rolled high-strength steel, comprising: casting a molten steel with microalloying element Ti added to obtain an ingot; after heating the ingot, subjecting it to rough rolling, finish rolling, laminar cooling and coiling to obtain a hot-rolled coil; after unloading the coil, covering the coil on-line with an insulating enclosure and moving it into a steel coil warehouse along with a transport chain; after a specified period of on-line insulating time, removing the coil from the insulating enclosure, and cooling it to room temperature in air, wherein the microalloying element Ti has a content of ≥0.03 wt %; the coiling is performed at a temperature of 500-700° C.; said covering on-line with an insulating enclosure means each hot-rolled coil is individually covered with an independent, closed insulating enclosure unit within 60 minutes after unloading; the on-line insulating time is ≥60 minutes. The method of the present disclosure is characterized by low cost and high efficiency, and is not affected by surroundings.

9 Claims, No Drawings

(56) References Cited

U.S. PATENT DOCUMENTS

| | | | | |
|---|---|---|---|---|
| 2014/0373981 | A1* | 12/2014 | Wang | C22C 38/58<br>148/541 |
| 2017/0369962 | A1* | 12/2017 | Goto | C21D 8/0205 |

FOREIGN PATENT DOCUMENTS

| | | | |
|---|---|---|---|
| CN | 104087839 | | 10/2014 |
| CN | 104438326 | | 3/2015 |
| CN | 104694822 | A | 6/2015 |
| CN | 206447906 | U | 8/2017 |
| CN | 107470377 | | 12/2017 |
| EP | 3015562 | A1 | 5/2016 |
| JP | S61159534 | A | 7/1986 |
| JP | 2015175004 | A | 10/2015 |
| JP | 2016130358 | A | 7/2016 |
| JP | 2016141848 | A | 8/2016 |

OTHER PUBLICATIONS

International Search Report and Written Opinion dated Dec. 3, 2018 for PCT Patent Application PCT/CN2018/106706.
Office Action dated Apr. 6, 2021 for Japanese Patent Application No. 2020537825.

* cited by examiner

PRODUCTION METHOD FOR INLINE INCREASE IN PRECIPITATION TOUGHENING EFFECT OF TI MICROALLOYED HOT-ROLLED HIGH-STRENGTH STEEL

CROSS-REFERENCE TO RELATED APPLICATIONS

This application is a 371 U.S. National Phase of PCT International Application No. PCT/CN2018/106706 filed on Sep. 20, 2018, which claims benefit and priority to Chinese patent application no. 201710853613.3 filed on Sep. 20, 2017, and 201810631903.8 filed on Jun. 19, 2018, respectively. Each of the above-referenced applications is incorporated by reference herein in their entireties.

TECHNICAL FIELD

The present disclosure pertains to the technical field of high-strength steel production, and particularly relates to a production method for on-line improving the precipitation strengthening effect of Ti microalloyed hot-rolled high-strength steel.

BACKGROUND ART

In recent years, micro-alloyed hot-rolled high-strength steel obtained by adding trace Ti element (0.01-0.20%) to the chemical composition of an ordinary C—Mn steel or low-alloy steel matrix has been used widely in automobiles, construction machinery, containers, bridges, constructions, and railway vehicles, and has become an important raw material for lightweight design and manufacturing in related industries. As a microalloying additive element in steel, Ti is mainly precipitated in the form of TiC or Ti (C, N), which can increase steel strength and improve the cold-forming performance and welding performance of steel.

Chinese Patent Publication No. CN102703812B discloses "a titanium microalloyed 500 MPa grade high-strength steel bar and a production method for the same", highlighting the principle of precipitation strengthening of titanium in steel to increase mechanical properties of steel, such as yield strength and tensile strength, etc. However, no study or description on how to improve the precipitation strengthening effect is available.

Chinese Patent Publication No. CN102965574B discloses "a titanium microalloyed hot-rolled thick steel plate having a low yield ratio and a high strength and a production process for the same", wherein an ingot is heated to 1220-1270° C., subjected to two-stage rolling in recrystallization and non-recrystallization zones of austenite to form a steel plate which is cooled to the self-tempering temperature for thermal straightening. After the steel plate is straightened, it is stacked and slowly cooled to promote precipitation strengthening. The literature entitled "Analysis of Slow Cooling Process For 2050 Finished High-Strength Steel" discloses the use of a slow cooling wall to control the cooling process of high-strength steel coils such as BS600MC, BS700MC and the like in a warehouse in order to improve the precipitation strengthening effect, internal stress distribution and plate shape quality. The literature entitled "Research on and Implementation of Construction Program of Slow Cooling Pit For 620 mm Strip Steel" has proposed the use of a slow cooling pit to perform temperature-controlled cooling of a variety steel coil in a 48-hour slow cooling cycle to make the overall temperature of the steel coil uniform. However, it's found in practical production that none of the above slow cooling processes can hold the temperature of the steel coils timely. In addition, the temperature holding effect is greatly affected by the surroundings of the slow cooling zone. For Ti microalloyed hot-rolled high-strength steel coils, it's particularly difficult to achieve effective insulation to improve the effect of precipitation strengthening.

Chinese Patent Publication No. CN102534141A discloses "a process for on-line induction heat treatment of precipitation-strengthened high-strength steel", wherein an uncoiled steel plate is subjected to induction heat treatment to fully precipitate the strengthened phase which is rendered in a dispersed state, so as to achieve the effect of improving the uniformity of the performances of the steel plate. However, this process requires uncoiling of a steel coil first, followed by reheating and temperature holding with the use of induction heating technology. There are many process steps, and additional induction heating equipment is needed.

SUMMARY

An object of the present disclosure is to provide a production method for on-line improving the precipitation strengthening effect of Ti microalloyed hot-rolled high-strength steel, which method is characterized by low cost and high efficiency, and is not affected by surroundings.

To achieve the above object, the technical solution of the present disclosure is as follows:

According to the present disclosure, after controlled rolling, controlled cooling and coiling of Ti microalloyed hot-rolled high-strength steel, the resulting steel coil is quickly covered with an independent, closed insulating enclosure unit, so that the steel coil is insulated and slowly cooled, and the residual heat from the coiling is used to homogenize the temperature across the steel coil to promote uniform and full precipitation of TiC, and maintain its size in nano-scale, thereby fulfilling the purpose of improving the precipitation strengthening effect.

In particular, the present disclosure provides a production method for on-line improving precipitation strengthening effect of Ti microalloyed hot-rolled high-strength steel, comprising: casting a molten steel with microalloying element Ti added to obtain an ingot; after heating the ingot, subjecting it to rough rolling, finish rolling, laminar cooling and coiling to obtain a hot-rolled coil; after unloading the coil, covering the coil on-line with an insulating enclosure and moving it into a steel coil warehouse along with a transport chain; after a specified period of on-line insulating time, removing the coil from the insulating enclosure, and cooling it to room temperature in air, wherein the microalloying element Ti has a content of ≥0.03 wt %; the coiling is performed at a temperature of 500-700° C.; said covering on-line with an insulating enclosure means each hot-rolled coil is individually covered with an independent, closed insulating enclosure unit within 60 minutes after unloading; the on-line insulating time is ≥60 minutes.

Preferably, the microalloying element Ti has a content of 0.03-0.10%;

Further, the ingot is heated at a temperature of ≥1,200° C., and a soaking time is ≥60 minutes.

Preferably, the ingot is heated at a temperature of 1200-1350° C., and the soaking time is 1-2 hours.

Further, the rough rolling is performed at a temperature of 1000-1200° C., wherein 3-8 passes of reciprocating rolling are performed, and a cumulative deformation is ≥50%;

Further, the finish rolling is performed with 6-7 passes of continuous rolling, wherein a cumulative deformation is ≥80%, and a final rolling temperature is 800-900° C.

Preferably, each hot-rolled coil is individually covered with an insulating enclosure within 20 minutes after it is unloaded.

Further, the steel coil is cooled at a cooling rate of ≤15° C./hour in the insulating enclosure.

Preferably, the on-line insulating time of the steel coil is 1-5 hours.

Further, an exemplary insulating enclosure is the on-line insulating and retarded cooling device on a steel strip production line in any embodiment disclosed by CN 107470377 A, the content of which is incorporated herein in its entirety by reference.

The manufacture process of the disclosure is designed for the following reasons:

Ti has a strong bonding force with C and N atoms in the steel. Only when an appropriate amount of Ti is added can all the requirements be met at the same time. When the content of Ti is less than 0.03%, TiN is formed mainly, and it prevents austenite grains from coarsening; when the content of Ti is ≥0.03%, the portion of Ti that exceeds the ideal chemical ratio of $\omega(Ti)/\omega(N)$ will be present in the form of a solid solution or fine TiC particles that significantly impede recrystallization, and achieve the effect of precipitation strengthening; however, when an excessive amount of Ti is added, nitrides and sulfides are formed on grain boundaries, resulting in embrittlement of the steel. Therefore, the content of Ti in the present disclosure is ≥0.03%, preferably in the range of 0.03-0.10%.

In the design of the rolling process, the heating temperature for the ingot must be sufficiently high (such as ≥1200° C.) to ensure that as many Ti atoms as possible are solid-dissolved in austenite. The upper limit of the heating temperature is limited by the temperature that is actually achievable or tolerable by a heating furnace. In principle, it's not necessary to set an upper limit. Nevertheless, in order to save energy and reduce consumption, the actual maximum heating temperature is usually controlled to be ≤1350° C.

The soaking time is ≥60 minutes. The soaking time refers to a period of time during which the ingot is held at a specified heating temperature to which the ingot is heated.

Austenite recrystallization rolling and austenite non-recrystallization rolling are performed at the rough rolling and finish rolling stages respectively. The recrystallization zone is arranged at the high temperature stage (e.g. a temperature of 1000-1200° C. for rough rolling) where the rolling resistance is small, and a large amount of deformation should be utilized to fully refine the austenite grains. The purpose of the rolling in the non-recrystallization zone (e.g. final rolling at a temperature of 800-900° C.) is to elongate the grains to increase dislocations and deformation bands, thereby increasing nuclei for new phase nucleation. The rough rolling and finishing rolling should be completed as quickly as possible to avoid precipitation of excessive Ti carbonitrides during the rolling stage, and retain as many Ti atoms as possible to allow for precipitation thereof after rolling.

After the final rolling, a control strategy is selected from one-stage precooling, two-stage cooling, and U-shape cooling and the like according to the requirements of the phase transformation structure. Anyway, accelerated cooling inhibits precipitation of nano-sized TiC. In addition, it's found in practical production that the cooling both during the accelerated cooling of the strip steel and after the coiling of the strip steel is not uniform, while precipitation strengthening is sensitive to temperature variation. As a result, the quantity and size of the precipitated phase are inconsistent at various parts of the steel coil, wherein precipitation is insufficient in local areas, which affects the uniformity of mechanical properties.

In order to further improve the precipitation strengthening effect, the coiling temperature is designed to be 500-700° C. which is the temperature range where TiC can precipitate fully. In addition, after each hot-rolled coil is unloaded, it is quickly covered on-line (preferably within 20 minutes) with an independent, closed insulating enclosure unit, wherein the insulating time is 1-5 hours, and the cooling rate of the steel coil in the insulating enclosure is ≤15° C./hour. As such, the residual heat after the coiling can be fully utilized to homogenize the temperature across the steel coil. Moreover, the steel coil is allowed to stay for an appropriate period of time in the temperature range where TiC can precipitate fully, so as to ensure uniform and full precipitation of TiC, and maintain the grain size in nano-scale. Thus, the effect of precipitation strengthening is maximized. The term "on-line" means that a steel coil should be covered with an insulating enclosure as soon as it is unloaded. Compared with an "off-line" mode where a steel coil is moved into a warehouse and then covered with an insulating enclosure: (i) the "on-line" mode ensures that the steel coil enters the enclosure in a temperature zone where TiC can precipitate fully; (ii) in the "off-line" mode, during the transportation of the steel coil before entering the insulating enclosure, the temperature drop at the inner circle, outer circle and sides is significantly greater than that at the middle, and thus the overall temperature uniformity of the steel coil is poor; (iii) in the "off-line" mode, the phase transformation uniformity in the steel coil is poor, and the precipitation of TiC is insufficient in local areas, which is unfavorable for uniformly improving the precipitation strengthening effect.

The beneficial effects of the present disclosure include:

(1) According to the manufacturing process of the present disclosure, a combination of Ti microalloying and insulation/slow cooling of a steel coil allows for homogenization of the temperature across the steel coil, and promotes uniform, full precipitation of TiC, the size of which is maintained in nano-scale, thereby fulfilling the purpose of improving the precipitation strengthening effect.

(2) By designing a reasonable rolling process in conjunction with an innovative "single coil" insulating and slow cooling process following coiling, the present disclosure can improve the precipitation strengthening effect of Ti microalloyed hot-rolled high-strength steel on-line at low cost with high efficiency, and improve strength properties and uniformity thereof.

(3) Compared with the conventional process of slow cooling in stack, the Ti microalloyed hot-rolled high-strength steel manufactured according to the present disclosure has an increase in yield strength of 10-40 MPa and an increase in tensile strength of 10-50 MPa.

DETAILED DESCRIPTION

The disclosure will be further illustrated with reference to the following specific Examples.

Table 1 shows the key process parameters of the Examples in the present disclosure, Table 2 shows the key process parameters of the Comparative Examples in the present disclosure, and Table 3 shows the properties of the steel coils of the Examples and the Comparative Examples in the present disclosure.

The process flow for the Examples in the present disclosure is as follows: providing an ingot comprising ≥0.03% Ti→heating the ingot→rough rolling→finish rolling→laminar cooling→coiling→covering with an insulating enclosure on-line→removing from the insulating enclosure, wherein the key process parameters are shown in Table 1.

The process flow for the Comparative Examples in the present disclosure is as follows: providing an ingot comprising ≥0.03% Ti→heating the ingot→rough rolling→finish rolling→laminar cooling→coiling→slow cooling the steel coil in stack, wherein the key process parameters are shown in Table 2.

TABLE 1

| Ex. | Steel coil thickness (mm) | Ti content (%) | Heating temperature (° C.) | Rough rolling temperature (° C.) | Final rolling temperature (° C.) | Coiling Temperature (° C.) | Covering time (min) | Insulating time (h) |
|---|---|---|---|---|---|---|---|---|
| 1 | 1.5 | 0.086 | 1255 | 1113 | 886 | 603 | 20 | 4 |
| 2 | 4.5 | 0.090 | 1261 | 1116 | 892 | 583 | 16 | 4 |
| 3 | 1.5 | 0.072 | 1261 | 1118 | 862 | 612 | 10 | 2 |
| 4 | 6.0 | 0.077 | 1245 | 1037 | 857 | 591 | 38 | 2 |
| 5 | 2.0 | 0.060 | 1249 | 1082 | 863 | 607 | 21 | 2 |
| 6 | 2.8 | 0.034 | 1258 | 1094 | 870 | 586 | 17 | 2 |

TABLE 2

| Comp. Ex. | Steel coil thickness (mm) | Ti content (%) | Heating temperature (° C.) | Rough rolling temperature (° C.) | Final rolling temperature (° C.) | Coiling Temperature (° C.) |
|---|---|---|---|---|---|---|
| 1 | 1.5 | 0.086 | 1251 | 1117 | 897 | 608 |
| 2 | 4.5 | 0.090 | 1264 | 1115 | 883 | 582 |
| 3 | 1.5 | 0.072 | 1260 | 1123 | 861 | 610 |
| 4 | 6.0 | 0.077 | 1243 | 1042 | 853 | 593 |
| 5 | 4.0 | 0.060 | 1252 | 1075 | 869 | 601 |
| 6 | 2.8 | 0.034 | 1261 | 1107 | 874 | 588 |

TABLE 3

| | Yield strength (MPa) | Tensile strength (MPa) | Elongation/% |
|---|---|---|---|
| Ex. | | | |
| 1 | 792 | 835 | 23 |
| 2 | 773 | 825 | 22 |
| 3 | 771 | 813 | 21 |
| 4 | 636 | 716 | 20 |
| 5 | 620 | 661 | 26 |
| 6 | 573 | 672 | 23 |
| Comp. Ex. | | | |
| 1 | 761 | 788 | 20 |
| 2 | 754 | 811 | 22 |
| 3 | 743 | 787 | 22 |
| 4 | 604 | 695 | 21 |
| 5 | 587 | 643 | 26 |
| 6 | 533 | 641 | 22 |

As can be seen from the data of the Examples and Comparative Examples in Table 3, in comparison with the method employing slow cooling of steel coils in stack, the Ti micro-alloyed hot-rolled high-strength steel produced by the method proposed by the present disclosure has a yield strength increase of 10-40 MPa, a tensile strength increase of 10-50 MPa, and a comparable elongation at break, indicating that the method proposed by the present disclosure can effectively improve the precipitation strengthening effect of TiC without compromising the plasticity index of the material.

The embodiments of the present disclosure are not limited to the foregoing examples. Any other changes, modifications, substitutions, combinations, and simplifications that do not depart from the spirit and principle of the present disclosure should all be equivalent alternatives, all falling in the protection scope of the present disclosure.

What is claimed is:

1. A production method for improving precipitation strengthening effect of Ti microalloyed hot-rolled high-strength steel, comprising:

casting a molten steel with microalloying element Ti added to obtain an ingot; after heating the ingot, subjecting it to rough rolling, finish rolling, laminar cooling and coiling to obtain a hot-rolled coil; after unloading the hot-rolled coil, covering each of the hot-rolled coil individually with an independent, closed insulating enclosure unit within 60 minutes and moving it into a steel coil warehouse along with a transport chain; after an insulating time of ≥60 minutes, removing the coil from the insulating enclosure, and cooling it to room temperature in air, wherein the microalloying element Ti has a content of ≥0.03 wt %; the coiling is performed at a temperature of 500-700° C.

2. The production method for improving precipitation strengthening effect of Ti microalloyed hot-rolled high-strength steel according to claim 1, wherein the microalloying element Ti has a content of 0.03-0.10 wt %.

3. The production method for improving precipitation strengthening effect of Ti microalloyed hot-rolled high-strength steel according to claim 1, wherein the ingot is heated at a temperature of ≥1200° C., and a soaking time is ≥60 minutes.

4. The production method for improving precipitation strengthening effect of Ti microalloyed hot-rolled high-strength steel according to claim 1, wherein the ingot is heated at a temperature of 1200-1300° C., and the soaking time is 1-2 hours.

5. The production method for improving precipitation strengthening effect of Ti microalloyed hot-rolled high-strength steel according to claim 1, wherein the rough rolling is performed at a temperature of 1000-1200° C., wherein 3-8 passes of reciprocating rolling are performed, and a cumulative deformation is ≥50%.

6. The production method for improving precipitation strengthening effect of Ti microalloyed hot-rolled high-strength steel according to claim 1, wherein the finish rolling is performed with 6-7 passes of continuous rolling, wherein a cumulative deformation is ≥80%, and a final rolling temperature is 800-900° C.

7. The production method for improving precipitation strengthening effect of Ti microalloyed hot-rolled high-strength steel according to claim 1, wherein each hot-rolled coil is individually covered with an insulating enclosure within 20 minutes after it is unloaded.

8. The production method for improving precipitation strengthening effect of Ti microalloyed hot-rolled high-strength steel according to claim 1, wherein the hot-rolled coil is cooled at a cooling rate of ≤15° C./hour in the insulating enclosure.

9. The production method for improving precipitation strengthening effect of Ti microalloyed hot-rolled high-strength steel according to claim 1, wherein the insulating time of the hot-rolled coil is 1-5 hours.

* * * * *